United States Patent [19]

Marlowe et al.

[11] Patent Number: 4,743,512

[45] Date of Patent: May 10, 1988

[54] METHOD OF MANUFACTURING FLAT FORMS FROM METAL POWDER AND PRODUCT FORMED THEREFROM

[75] Inventors: David T. Marlowe; Gregory J. Del Corso, both of Sinking Spring; Robert E. Carnes, Reading; David Esposito, Wernersville; William J. Burns, II, Reading; Edward F. Holland, Temple; David L. Strobel, Reading, all of Pa.

[73] Assignee: Carpenter Technology Corporation, Reading, Pa.

[21] Appl. No.: 68,447

[22] Filed: Jun. 30, 1987

[51] Int. Cl.[4] ..... B22F 3/00

[52] U.S. Cl. ..... 428/552; 75/236; 75/246; 75/248; 149/5; 149/6; 149/17; 149/30; 149/31; 149/32; 149/38; 149/43; 149/44; 149/47; 149/56; 428/636; 428/637

[58] Field of Search ..... 149/5, 6, 17, 43, 47, 149/44, 30, 31, 32, 38, 56; 428/636, 637, 552; 75/236, 246, 248

[56] References Cited

U.S. PATENT DOCUMENTS

| | | | |
|---|---|---|---|
| 3,245,114 | 4/1966 | Ready et al. | 18/9 |
| 3,892,832 | 7/1975 | Schey | 419/48 |
| 3,975,193 | 8/1976 | Nayar | 419/31 |
| 3,979,234 | 9/1976 | Northcutt, Jr. et al. | 75/221 |
| 4,207,120 | 6/1980 | Armstrong et al. | 419/3 |
| 4,332,617 | 6/1982 | Hovis et al. | 75/214 |
| 4,478,787 | 10/1984 | Nadkarini et al. | 419/50 |
| 4,491,559 | 1/1985 | Grab et al. | 419/36 |
| 4,569,822 | 2/1986 | Brown et al. | 419/43 |
| 4,602,954 | 7/1986 | Davies et al. | 75/232 |
| 4,605,599 | 8/1986 | Penrice et al. | 428/665 |
| 4,617,054 | 10/1986 | Mathers | 75/246 |

FOREIGN PATENT DOCUMENTS 1171327 11/1969 United Kingdom .

OTHER PUBLICATIONS

G. Naeser et al., "Rolling of Strip from Iron Powder", Stahl & Eisen, vol. 70, pp. 995–1004 (1950).

R. A. Smucker, "Perfected and Practical Methods of Processing Powder into Commercial Strip", Iron and Steel Engr., vol. 36, No. 7, pp. 118–124 (1959).

W. H. Lenz et al., "The Powder Rolling of Molybdenum and Tungsten", Los Alamos National Lab Report, No. W-7405-ENG. 36 (1961).

T. J. Ready et al., "A Technique for Powder Rolling Tungsten and Tungsten–45 vol. % $UO_2$ Dispersions", International Journal of Powder Metallurgy, vol. 1, No. 2, pp. 56–63 (1965).

V. A. Tracey, "The Roll Compaction of Metal Powders", Powder Metallurgy, vol. 1, No. 24, pp. 598–612 (1969).

K. D. Lietzmann et al., "Powder Rolling—New Possibilities for the Manufacture of Wide Flat Products", Neue Hutte, vol. 17, No. 9, pp. 539–546 (1972).

Unknown, "Influence of Oxygen Traces on the Properties of Tungsten Heavy Metal", Z. Werksofftech, vol. 15, pp. 96–102 (1984).

R. F. Cheney, "Sintering of Refractory Metals", ASM Metals Handbook, vol. 7, pp. 392–393 (9th ed. 1984).

W. V. Knopp et al., "Roll Compaction of Metal Powders, ASM Metals Handbook, vol. 7, pp. 401–409 (9th ed. 1984).

A. Bose, et al., "Liquid Phase Sintering of Tungsten Heavy Alloys", presented at Annual Powder Met. Conf. and Exh. (5/86).

W. F. Gurwell, "A Review of Enbrittlement Mechanisms in Tungsten Heavy Alloys", presented at Annual Powder Met. Conf. and Exh. (5/86).

P. C. Eloff, "The Technology of Powder Rolling", Carbide and Tool Journal, pp. 28–32 (5–6/86).

*Primary Examiner*—Stephen J. Lechert, Jr.

*Attorney, Agent, or Firm*—Dann, Dorfman, Herrell and Skillman

[57] ABSTRACT

A method of manufacturing a flat form from blended metallic powder including a major constituent by weight having a high melting point and a minor constituent by weiht having a substantially lower melting point includes selection of the powder to provide continuous and reproducible compacted flat forms. Powder is selected on the basis of compressibility and flowability. The selected powder is compacted to a flat green form and then liquid phase sintered. The flat form may be stacked to provide a flat article of a desired thickness which will result in a monolithic or composite cross section when subsequently sintered. Liquid phase sintering is carried out in a manner designed to avoid undesirable embrittlement and to provide a uniform microstructure in the fully consolidated article. The process is especially useful in the production of tungsten heavy alloy plate.

36 Claims, No Drawings

METHOD OF MANUFACTURING FLAT FORMS FROM METAL POWDER AND PRODUCT FORMED THEREFROM

FIELD OF THE INVENTION

This invention relates to consolidation of metal powders into flat forms. More particularly, the invention relates to a method of producing near net shape flat forms from metal powder having at least one high melting temperature constituent.

BACKGROUND OF THE INVENTION

The manufacture of flat forms from refractory metal powder often includes compaction, such as by rolling, of the metal powder to a green compact, followed by liquid phase sintering of the compacted powder. Here and throughout this application the term "compaction" means the compression of a mass of metal powder to an abiding form e.g., a green compact. Whereas the term "consolidation" means the densification of a mass of metal powder whether by compaction or other means, such as sintering or mechanical hot working. Further consolidation such as by mechanical hot working after sintering is usually required to obtain the desired net shape. Known processes for producing such flat forms as plate have several disadvantages.

First, roll compaction of refractory metal powders is difficult because the fine, brittle particles flow poorly and do not readily weld under pressure during rolling. Ready et al., U.S. Pat. No. 3,245,114 issued Apr. 12, 1966 relates to apparatus which is claimed to provide "satisfactory and reproducible rolling" of powders of tungsten and tungsten alloys. Ready et al. describes a complex roll compacting apparatus, but it is not disclosed or suggested that the apparatus is capable of rolling strip much wider than 4 inches, e.g., 12 inch wide strip. The Ready et al. patent, however, does not disclose what effect the powder characteristics have on roll compactibility. In a related publication, T. J. Ready and H. D. Lewis, "A Technique for Powder Rolling Tungsten and Tungsten—45 v/o $UO_2$ Dispersions", Int'l J. of Powder Met. Vol. 1, No. 2 (1965), it was suggested that roll compactibility of a powder was primarily dependent on particle size distribution and particulate characteristics.

Another disadvantage of known powder roll compaction processes is the difficulty in consistently forming green compacted flat forms with dry powder. P. C. Eloff, "The Technology of Powder Rolling", Carbide and Tool Jour. (May/June 1986) and Grab et al., U.S. Pat. No. 4,491,559 describe the use of binders to overcome some of the problems associated with roll compaction of dry powders. However, the use of binders requires an extra processing step to remove the binder material prior to sintering. Nevertheless, all of the binder material cannot be removed resulting in the retention of undesirable impurities in the finished product.

Another disadvantage of the known methods of producing flat forms from metal powder is the limitation on thickness which can be practically obtained. Thick plate manufactured by roll compaction is not practical because extremely large diameter rolls would be required.

A further disadvantage of the known processes is that catastrophic blistering can occur during liquid phase sintering. Such blistering renders the flat form product unusable. Although the mechanism by which such blistering occurs has been studied, there has been no effective method for eliminating or at least significantly controlling such blistering.

A still further disadvantage of the known processes is the retention in the sintered material of undesirable impurities such as hydrogen and oxygen which can result in embrittlement and poor mechanical properties. Special sintering cycles have been devised, such as that described in Bose et al., "Liquid Phase Sintering of Tungsten Heavy Alloys in Vacuum," Proc. of the Annual Powder Metallurgy Conf. and Exhibit, May, 1986, in an attempt to overcome impurity entrapment. However, such special sintering cycles require a post-sintering heat treatment to remove residual hydrogen and obtain the desired properties. Such additional post-sintering processing results in a substantial economic disadvantage.

SUMMARY OF THE INVENTION

A principal object of this invention is to provide a method for producing a flat form from metal powder, a major constituent of which is at least one refractory material, in which the powder characteristics are related to assure continuous and reproducible roll compaction of green strip.

Another object of the invention is to provide such a method which produces flat forms in a wide range of thicknesses.

Another object of the invention is to provide such a method having a liquid phase sintering cycle which prevents blistering.

A further object of this invention is to provide such a method which produces a flat form having a uniform microstructure.

A still further object of the invention is to provide a method for producing a flat form having a composite cross section.

The above objects and other advantages of the present invention are realized in a process of producing a flat form, such as strip, sheet or plate from metallic powder. The process is particularly suitable for metal powder having a major constituent by weight which has a high melting point and a minor constituent by weight which has a relatively low melting point. The major constituent must have a limited solubility in the minor constituent, whereas the minor constituent must be substantially insoluble in the major constituent.

The process includes selecting powder which is consistently compactible to strip. Hereinafter, the term "strip" means green strip or sheet. Selection is based on the criteria of compressibility and flowability of the powder. Compressibility is defined as the ratio of the green density of a powder to its apparent density as will be described more fully herein below. The powder of the major constituent is selected to have a compressibility sufficient to provide compacted strip which is sufficiently abiding to be physically handled without breaking up. The compressibility is upwardly indexed as the strip width is increased with the condition that the compressibility must be equivalent to a green to apparent density ratio of at least about 2 when forming 4 inch (10.2 cm) wide strip.

Flowability is inversely proportional to the angle of repose of the powder blend of the major and minor constituents. The flowability is upwardly indexed as the strip width is increased with the condition that the flowability must be equivalent to an angle of repose not greater than 76° from the horizontal when forming 4 inch (10.2 cm) wide strip.

The thus selected powder is compacted to a desired width and thickness. The powder may be compacted to continuous strip which is then liquid phase sintered in batches to consolidate it to substantially theoretical density. The strip is preferably cut into sections prior to sintering. The sections are stacked to form workpieces of monolithic cross section. The strip sections may also be stacked with strip sections of different composition to form workpieces having a composite cross section.

The workpieces are heated to the liquid phase sintering temperature in a reducing atmosphere, preferably a reducing fluid at subatmospheric pressure. The workpieces are preferably heated in a manner controlled, as more fully described herein below, such that the strip is deoxidized and further consolidated to reduce slumping during liquid phase sintering. The heating cycle is controlled also so that the liquid phase forms uniformly, thereby preventing blistering.

A post sintering step for removing entrapped impurities may be employed. However, in the preferred mode, the sintered plate can simply be cooled in an inert atmosphere. If necessary, warm or cold working can be employed to remove any distortion in the sintered pieces.

Flat product formed by the process has a uniform microstructure composed of particles of the major constituent which are substantially free of the minor constituent, in an alloy matrix containing both the major and minor constituents.

DETAILED DESCRIPTION

The formation of a flat form according to the method of this invention requires a selection step for providing powder which is compactible. It is an important advantage of the present invention that the powder can be consistently compacted without using binders. The powders to which the present method is directed include a first or major constituent by weight of a high melting point material, including, but not limited to, such refractory materials as tungsten, molybdenum and carbides thereof. Metal powders of such materials are difficult to compact because they consist of fine brittle particles which flow poorly and tend not to weld under pressure during rolling. The second or minor constituent which forms the balance of the powder used in this process is of such minor proportion by weight that it cannot impart compactibility to an otherwise non-compactible first constituent powder. The minor constituent powder is a relatively softer, lower melting point material such as nickel, copper, cobalt, iron or combinations thereof. An important feature of the constituents is that the first or high melting point constituent has a limited solubility in the second constituent and that the second or low melting point constituent be substantially insoluble in the first.

In the process of the present invention, the critical parameters in selecting powder for compaction are the compressibility and flowability of the powder. Green strength, although an important criteria, is not sufficient by itself to define handleable compacted strip. Compressibility is indicated by the ratio of a powder's green density to its apparent density. The apparent density of a powder is its weight per unit volume. Green density is the weight per unit volume of a powder pressed into a green compact. Flowability of the powder is indicated by its angle of repose, that is, the angle, measured from the horizontal, which is formed when the powder is allowed to fall freely onto a flat surface.

It is a feature of this invention that the refractory metal or major constituent powder must have a compressibility corresponding to a minimum green to apparent density ratio, when die pressed at 80 ksi (550 MPa), in order to successfully compact when blended with the minor constituent. The green to apparent density ratio is upwardly indexed as the width of the strip to be rolled is increased. For example, when rolling 4 inch 10.2 cm) wide strip a green to apparent density ratio of at least 2 has been found to provide adequate roll compactibility. However, when compacting 12 inch (30.5 cm) wide strip, a green to apparent density ratio of at least 2.5 is preferred.

Flowability can be determined from the blended powder containing both the major and minor constituents. It is a further feature of this invention that the flowability is upwardly indexed as the width of the strip to be compacted is increased. Flowability is inversely related to the angle of repose. Thus, as the width of the strip to be compacted is increased, the angle of repose is downwardly indexed. For example, when rolling 4 inch (10.2 cm) wide strip with powder having the necessary compressibility, a maximum angle of repose of about 76° has been found to provide adequate roll compactibility. However, when compacting 12 inch (30.5 cm) wide strip with powder having the requisite compressibility, a maximum angle of repose of about 60° is preferred. Flowability can be determined from the blended powder because the minor constituent has relatively little effect on the angle of repose.

Although commercially available refractory metal powders, for example tungsten powders, usually have very fine particles, for example less than 10 micrometers, they do not all have the same compressibility and flowability. Accordingly, it may be preferable to blend together two or more batches of different commercial refractory metal powders in order to obtain a batch which has the necessary compressibility and flowability. Powder which does not initially meet the compressibility and flowability criteria can be returned for blending with other batches of powder. In this way the initially unacceptable powder can be recycled to enhance its roll compactibility. Such recycling leads to higher yields, resulting in better economy.

Blending of the first and second constituent powders together prior to compaction is done for a time sufficient to obtain a substantially uniform distribution of constituents throughout the batch. The moisture content of the blended powder is controlled prior to compaction because excessive retained moisture or excessive dryness can adversely affect the flow characteristics of the blended powders.

The preferred method of compacting the blended powder is roll compaction. Roll compaction of the blended powder is carried out by loading the blended powder into a feed hopper used to supply the powder to the opposed rolls of the compaction mill. It is preferred that a vibratory type feed hopper be used. Either a starvation or saturation feed mode may be used, although the starvation type feed is preferred. In order to improve the consistency with which the blended powder is roll compacted the rolls of the compaction mill are preferably preconditioned, as by heating to about 100° F. (38° C.) max. prior to and initially during the roll compaction process. Further to this end, the blended powder itself can be warmed, as by maintaining at about 150°-200° F. (65°-93° C.).

The roll speed, force and gap are set in order to obtain continuous strip of a desired thickness. The powder can be rolled into continuous strip which may be cut to form sections having a desired length. The roll compacted strip preferably has a green density of at least about 65% of theoretical density.

Edge material having less than the required density is preferably trimmed away before further consolidation to theoretical or near theoretical density. Also, the compacted green strip can be trimmed to a desired width before further consolidation.

The roll compacted strip is consolidated by liquid phase sintering to theoretical or near theoretical density as desired. In accordance with one embodiment of this invention, a single layer of strip is sintered to provide fully dense flat form. In another embodiment, two or more layers of strip, or sections of strip, are stacked in surface-to-surface contact and then sintered to a final form having a desired thickness. Composite structures can also be formed by layering strip, or sections of strip, of different compositions so that one or more layers is juxtaposed to at least one other layer having a different composition. For example, a high strength layer can be sandwiched between high toughness layers. If desired, reinforcing rods or mesh can be placed between layers of strip or strip sections of same composition. In this manner, flat form of varying composition and mechanical properties resulting therefrom is provided.

The workpiece to be sintered, whether compacted strip or stacked layers thereof, is placed on a non-reactive, preferably ceramic, support and inserted into a sintering furnace. The strip is sintered in a reducing atmosphere which is introduced at the start of the heatup cycle and continued during the liquid phase sintering of the workpiece. In accordance with one embodiment of this invention the reducing atmsphere can be a reducing fluid at positive pressure, i.e., a "full" reducing atmosphere. A preferred reducing fluid is wet hydrogen, that is, hydrogen with a relatively high dew point. The use of a full reducing atmosphere, however, can lead to undesirable retention of impurities such as hydrogen and oxygen which are retained in pores within the sintered sections. Accordingly, a post-sintering heat treatment is preferred to remove such impurities and thereby obtain the best properties.

In a preferred embodiment of the process, the liquid phase sintering step is carried out in the presence of a reducing gas under subatmospheric pressure. This preferred mode obviates the need for special post-sintering degassification.

In the preferred mode, the atmosphere inside the furnace is evacuated after the sections of the compacted strip are placed into the sintering furnace. Dry reducing gas, that is, gas having a relatively low dew point, such as dry hydrogen, is introduced and continuously flushed through the furnace over the workpieces. The dry reducing gas is preferably maintained at a pressure of about 2 torr. The use of concentrations of reducing gas equal to or greater than about 5 torr results in blistering of the sintered pieces.

For best results, heating of the workpieces up to the liquid phase sintering temperature is carefully controlled to minimize and preferably to avoid altogether embrittlement of the sintered product. To this end the compacted strip, or sections thereof, are heated in a controlled manner. The temperature is first increased at a rate not greater than about 15° F./minute (about 8° C./minute) to a temperature in the range of about 1400°-1000° F. (about 760°-1100° C.), preferably about 1650°-1850° F. (about 900°-1000° C.). The work pieces are maintained at that temperature for a time sufficient to provide substantially complete deoxidation of the strip.

In order to limit slumping and distortion of the workpieces when they are subsequently liquid phase sintered, it is preferred that they be consolidated to at least about 95% of theoretical density prior to liquid phase sintering. To this end, after sufficient deoxidation has occurred, the temperature is again increased at a rate not greater than about 15° F./minute (about 8° C./minute) to a temperature at which solid state sintering occurs. This temperature will be below the temperature at which incipient melting of the lower melting point constituent occurs, but high enough to provide diffusion bonding of the powder particles. The work pieces are maintained at the solid state sintering temperature for a time sufficient to attain the desired density.

Following the solid state sintering period, the temperature is increased at a rate not greater than about 5° F./minute (about 2.75° C./minute) to a temperature at which liquid phase sintering occurs. A slow heatup rate is preferred in order to suppress catastrophic blistering which occurs when the liquid phase forms non-uniformly, especially between stacked strip or strip sections. The work pieces are liquid phase sintered at a temperature and for a time sufficient to fully densify them. The liquid phase sintering temperature should be sufficiently above the incipient melting temperature of the minor constituent to effect coarsening of the particles of the first constituent by dissolution and reprecipitation of the first constituent in a liquid phase containing both the first and second constituents.

It will be appreciated by those skilled in the art that deoxidation, solid state sintering, and liquid phase sintering are all subject to a time-temperature relationship. In this respect, the desired objective of the particular step may be accomplished at different temperatures by varying the amount of time of the holding period. Accordingly, for a given composition and temperature, the time necessary at such temperature to achieve the desired end result can be determined by known analytical methods. The result achieved at a higher temperature can be achieved at a lower temperature if the workpiece is maintained at the lower temperature for a longer period of time. For example, an alloy containing about 90 w/o W, 7 w/o Ni and 3 w/o Fe was sufficiently deoxidized after one hour at 1850° F. (1010° C.). Sufficient consolidation to limit slumping and distortion was achieved by solid state sintering for one hour at 2550° F. (1400° C.). Full densification and sufficient alloying of the matrix was achieved by liquid phase sintering at 2700° F. (1480° C.) for about 15-30 minutes.

In the case where a subatmospheric pressure is not employed during the liquid phase sintering step it will be necessary to employ a post-sintering degassification step. Post-sintering degassification removes undesirable, entrapped impurities such as hydrogen and oxygen from the sintered workpiece by heating the workpiece in an inert atmosphere such as a vacuum or an inert gas. If not removed, such impurities can cause embrittlement of the as-sintered product with a resulting adverse effect on its mechanical properties. However, when a subatmospheric pressure is used during the liquid phase sintering cycle, the as-sintered plate need only be cooled in an inert atmosphere such as nitrogen.

The fully dense plate formed by the foregoing process can exhibit a certain amount of distortion as a result of the liquid phase sintering process. However, such distortion can be readily removed with a simple, inexpensive warm or cold working procedure such as rolling.

EXAMPLE

As an example of the process of the present invention, plate product was produced as follows. 162 lb (73.5 kg) of General Electric type UB5.0 tungsten powder and 162 lb (73.5 kg) of GTE type M65 tungsten powder were filtered through a 170 mesh screen and preblended together for 2 hours in a twin shell blender. A sample of the preblended tungsten powder was tested for compressibility and flowability. Part of the sample was heated to reduce its moisture content and then cooled to room temperature prior to being die pressed. The powder was poured into the die, leveled and then compressed at 80 ksi (550 MPa).

The ratio of the density of the pressed tungsten powder to the apparent density of the powder was determined to be 2.64. The angle of repose of the remaining part of the sample was determined to have an angle of repose of 48°, measured from the horizontal.

The tungsten powder was blended with 36 lb (16.3 kg) of a preblend of INCO type 123 nickel powder and BASF type CM iron powder. The Ni-Fe blend had a weight ratio of 7 Ni:3Fe. The tungsten and nickel-iron preblends were then blended together for 4 hours in a twin shell blender. The angle of repose of the blended W-Ni-Fe powder was determined to be 51.3°, as measured from the horizontal.

The blended powder was heated to 250° F. (121° C.) and then fed into the feed hopper of the roll compaction mill. A Syntron model V-20 vibrator was used to vibrate the hopper and a constant feed head of about 40 lbs of powder was maintained in the hopper during roll compaction. The powder was fed from the hopper to the roll gap through an opening 11 inches (27.9 cm) wide to provide strip about 12 inches (30.5 cm) wide. A doctor blade was used to control the powder flow into the roll gap providing a starvation feed. The doctor blade gap was set at 21/64 inch (8.33 mm).

The powder was roll compacted in a two-high, mill having vertically positioned rolls. A roll speed of 1 foot/minute (30.5 cm/minute) was used. The roll gap was initially set at 0.060 inch (1.5 mm), but as powder began to flow through the nip the rolls were brought down 0.080 inch (2.0 mm) to an apparent gap of −0.020 inch (−0.5 mm). This apparent negative gap is believed to result from elastic deformation of the roll housing and is inherent in the adjustment of the roll compaction mill used.

Continuous 12 inch (30.5 cm) wide green strip was rolled from the powder and then cut into sections 28 inches (71.1 cm) long. The sections had thickness which varied between 0.061 inch (1.55 mm) to 0.064 inch (1.63 mm) from section to section. The edges of the strip sections were trimmed to a width of 11 inches (27.9 cm).

The strip sections were stacked 4 high to form workpieces having an approximate thickness of 0.240 (6.1 mm) inch. The stacked sections were placed on alumina tiles arranged side by side and then inserted into the sintering furnace.

The workpieces were then sintered to full density with the following cycle. The furnace was initially evacuated to less than 10 microns. The temperature was then increased to 1000° F. (538° C.) at the rate of 15° F./minute (8° C./minute). When the temperature reached 1000° F. (538° C.), the diffusion vacuum pumps were isolated and only the mechanical vacuum pumps were continued. Dry hydrogen was introduced at a flow rate of 35 cubic feet per hour (cfh) (1 $m^3$/hour) to provide a subatmospheric pressure of 1–2 mmHg. The dew point of the atmosphere inside the furnace was determined to be −35° F. (−37° C.).

Meanwhile, the temperature was continued to be increased at 15° F./minute (8° C./min.) to 1850° F. (1010° C.). The temperature was held at 1850° F. (1010° C.) for 90 minutes in order to deoxidize the compacted powder. After the deoxidation hold, and while continuing to maintain a hydrogen atmosphere of 1–2 mmHg, the temperature was again increased at 15° F./minute from 1850° F. (1010° C.) to 2550° F. (1400° C.). The temperature was held at 2550° F. (1400° C.) for 90 minutes in order to permit the workpiece to consolidate to at least 95% of theoretical density by solid state sintering.

After the solid state sintering hold, and while continuing to maintain a hydrogen atmosphere of 1–2 mmHg, the temperature was increased at 5° F./minute (2.75° C./minute) from 2550° F. (1400° C.) to a liquid phase sintering temperature of 2710° F. (1488° C.). The temperature was maintained at 2710° F. for 30 minutes.

At the end of the liquid phase sintering hold the furnace power was turned off and the consolidated workpieces' were allowed to cool in place.

The hydrogen atmosphere was maintained as the workpieces' temperature descended from 2710° F. (1488° C.) to 2000° F. (1093° C.). Between 2000° F. (1093° C.) and 1600° F. (871° C.) the furnace was evacuated to 20 microns in order to completely remove the hydrogen. When the temperature of the workpieces reached 1600° F. (871° C.), dry nitrogen was introduced into the furnace at a rate of 80 cfh (2.3 $m^3$/hour) to provide a slightly negative pressure of 5 in Hg. After the workpieces cooled to 800° F. (427° C.) the vacuum pumps were isolated and a positive pressure of 15 psig (0.1 Mpa) of the nitrogen was provided until the temperature of the workpieces reached 200° F. (93° C.) at which time the nitrogen was discontinued.

The as-consolidated plate was determined to have an oxygen content of 59 ppm*. The ultimate tensile strength of the plate was determined to be 132.6 ksi* (914 MPa) and its ductility as indicated by percent elongation in 4 diameters was measured to be 30.9%*.

*Average of two measurements.

Alloy plate formed by the process of the present invention has a uniform microstructure composed of particles of the major constituent which are substantially free of the minor constituent, in an alloy matrix containing both the major and minor constituents.

The process is suitable for a wide variety of material and is especially suitable for producing tungsten heavy alloy plate. Commonly used tungsten heavy alloys contain 80–97 w/o tungsten and a balance of nickel and iron in a weight percent ratio ranging from 7 Ni:3 Fe to 1 Ni:1 Fe.

It can be seen from the foregoing description that the present invention provides a novel process for producing flat forms from refractory metal powder in which the powder characteristics of compressibility and flowability are defined to provide continuous and reproducible roll compaction of green strip. Flat product can be produced with a desired thickness. The process also minimizes retention of undesirable impurities and prevents blistering of the liquid phase sintered workpieces. It is a further feature and advantage of the process that flat forms having a composite cross section with resulting variation of mechanical properties can be produced.

The terms and expressions which have been employed are used as terms of description and not of limitation. There is no intention in the use of such terms and expressions of excluding any equivalents of the features described or portions thereof. It is recognized, however, that various modifications are possible within the scope of the invention claimed.

What is claimed is:

1. A method of forming a flat article having a predeterminted width from metallic powder comprising the steps of:

providing blended metallic powder a major proportion by weight of which are particles of a first constituent and a minor proportion by weight of which are particles of a second constituent, said first constituent having a melting point substantially higher than said second constituent and being only partially soluble in said second constituent, said second constituent being substantially insoluble in said first constituent, said first constituent having a compressibility defined as the ratio of its green density to its apparent density with said green density being determined from particles that are die pressed with a force of 80 ksi, said compressibility being equivalent to at least about 2 when said flat article is not greater than about 4 inches wide and being indexed upwardly when the article width is increased, said blended metallic powder having a flowability defined as the angle of repose of the blended powder which has been freely flowed onto a horizontal surface, said flowability being equivalent to an angle of repose not greater than about 76° from the horizontal when said flat article is not wider than about 4 inches and said flowability being indexed upwardly when the article width is increased;

compacting the blended metallic powder to a flat form composed of a plurality of particles of said blended metallic powder;

deoxidizing the blended metallic powder particles; and sintering said flat form at liquid phase sintering temperature for a time sufficient to fully densify the form.

2. A method as recited in claim 1 wherein the compressibility of the first constituent particles corresponds to a green to apparent density ratio of at least about 2.5, when die pressed at 80 ksi.

3. A method as recited in claim 2 wherein the flowability of the blended metallic powder corresponds to an angle of repose not greater than 60°.

4. A method as recited in claim 1 wherein the step of providing the blended metallic powder comprises the steps of:

testing at least one batch of powder of the first constituent for compressibility;

selecting powder from said batch having the defined compressibility;

blending the selected first constituent powder with a second batch of powder of the second constituent such that the blended powder contains a major proportion by weight of the first constituent powder;

testing the blended powder for flowability; and selecting blended powder having the defined flowability.

5. A method as recited in claim 1 wherein said first constituent is a metallic substance selected from the group consisting of refractory metals and refractory metal carbides.

6. A method as recited in claim 5 wherein said second constituent is a metal selected from the group consisting of nickel, copper, cobalt, iron and combinations thereof.

7. A method as recited in claim 1 further comprising the steps of:

cutting the flat form into sections each having a desired length; and stacking two or more sections of the flat form.

8. A method as recited in claim 1 further comprising the steps of:

cutting the flat form into sections each having a desired length; and stacking sections of the flat form with sections of a second flat form having a substantially different composition therefrom, whereby a composite form is produced.

9. A method as recited in claim 1 wherein the step of deoxidizing the blended metallic particles comprises the steps of:

heating the flat form at a rate not greater than 15° F./minute to a temperature at which deoxidation of the form occurs; and maintaining the form at said temperature for a time sufficient to substantially completely deoxidize the form.

10. A method as recited in claim 1 comprising the further steps of:

heating the flat form at a rate not greater than 15° F./minute to a temperature at which solid state sintering occurs; and maintaining the flat form at said temperature until it is consolidated to a density of at least about 95% of theoretical density.

11. A method as recited in claim 1 wherein the flat form is heated to the liquid phase sintering temperature in the presence of a reducing atmosphere.

12. A method as recited in claim 1 wherein the flat form is heated to the liquid phase sintering temperature at subatmospheric pressure.

13. A method as recited in claim 1 wherein the flat form is maintained at liquid phase sintering temperature for a time sufficient to coarsen particles of the first constituent by dissolution and reprecipitation of the first constituent in a liquid phase containing both said first and second constituents.

14. A method as recited in claim 1 comprising the further step of removing entrapped impurities from the liquid phase sintered form.

15. A method as recited in claim 14 wherein the step of removing entrapped impurities comprises the step of heating the liquid phase sintered form in an inert atmosphere.

16. A method as recited in claim 1 comprising the further step of cooling the liquid phase sintered form in an inert atmosphere.

17. A method of forming a heavy alloy plate from metal powder comprising the steps of:

providing a blended metal powder consisting essentially of 80–97 w/o of tungsten powder and the balance essentially nickel and iron powders in a ratio ranging from 7 Ni:3 Fe to 1 Ni:1 Fe, said tungsten powder having a compressibility defined as the ratio of its green density to its apparent density when said green density is determined from particles that are die pressed at 80 ksi, said compressibility being equivalent to at least about 2 when said plate is not wider than about 4 inches and being indexed upwardly when the plate width increases, said blended metal powder having a flowability defined as the angle of repose of the blended metal powder which has been freely flowed onto a horizontal surface, said flowability being equivalent to an angle of repose not greater than about 76° from the horizontal when said flat article is not wider than about 4 inches, said angle of repose being indexed downwardly when the plate width is increased;

roll compacting the blended metal powder into a substantially continuous strip having a green density of at least about 65% of theoretical density;

cutting the strip into a plurality of sections each having a desired length;

stacking two or more sections surface to surface;

heating the stacked sections in the presence of a reducing agent to an elevated temperature at which liquid phase sintering of the stacked sections occurs;

controlling the temperature of the stacked sections while heating them such that the sections are deoxidized, further consolidated and such that a liquid phase is formed substantially uniformly; and maintaining the stacked sections at the liquid phase sintering temperature for a time sufficient to densify the stacked sections to an integral plate of substantially theoretical density.

18. A method as recited in claim 17 wherein the compressibility of the first constituent particles corresponds to a green to apparent density ratio of at least about 2.5, when die pressed at 80 ksi.

19. A method as recited in claim 17 wherein the step of providing the metallic powder comprises the steps of:

testing at least one batch of tungsten powder for compressibility;

selecting tungsten powder from said batch having a compressibility corresponding to a green to apparent density ratio of at least about 2;

blending the selected tungsten powder with a second batch of powder containing nickel and iron such that the blended powder contains a major proportion by weight of the tungsten powder;

testing the blended W-Ni-Fe powder for flowability; and selecting blended powder having a flowability corresponding to an angle of repose not greater than 76°.

20. A method as recited in claim 17 wherein the step of stacking the strip sections comprises the step of:

stacking sections of the roll compacted strip with similarly dimensioned sections of a second strip having a substantially different composition therefrom, whereby a composite plate is formed.

21. A method as recited in claim 17 wherein the step of heating the roll compacted strip comprises the steps of:

heating the roll compacted strip at a rate not greater than about 15° F./minute to a first temperature at which deoxidation of the strip occurs;

maintaining the strip at said first temperature for a time sufficient to substantially completely deoxidize the strip;

heating the deoxidized strip from said first temperature at a rate not greater than about 15° F./minute to a second temperature at which solid state sintering occurs;

maintaining the deoxidized strip at the second temperature until the strip is consolidated to a density of at least about 95% of theoretical density; and heating the partially consolidated strip from said second temperature at a rate not greater than 5° F./minute to liquid phase sintering temperature.

22. A method as recited in claim 17 wherein the roll compacted strip is heated to liquid phase sintering temperature at subatmospheric pressure.

23. A method as recited in claim 17 wherein the strip is maintained at liquid phase sintering temperature for a time sufficient to coarsen the tungsten particles by dissolution and reprecipitation of the tungsten particles in a liquid phase containing tungsten, nickel and iron.

24. A method as recited in claim 17 comprising the further step of removing entrapped impurities from the liquid phase sintered strip.

25. A method as recited in claim 22 wherein the step of removing entrapped impurities comprises the step of heating the liquid phase sintered strip in an inert atmosphere.

26. A method as recited in claim 17 comprising the further step of cooling the liquid phase sintered strip in an inert atmosphere.

27. An alloy plate formed by the method of claim 1 having an essentially uniform microstructure composed of particles of the first constituent which are substantially free of the second constituent, in an alloy matrix containing both the first and second constituents.

28. An alloy plate as recited in claim 27 which is substantially devoid of blisters.

29. An alloy plate as recited in claim 27 wherein the first constituent is a metallic substance selected from the group consisting of refractory metals and refractory metal carbides, and the second constituent is a metal selected from the group consisting of nickel, copper, cobalt, iron and combinations thereof.

30. An alloy plate formed by the method of claim 8 having a gradient of mechanical properties through its thickness.

31. A plate formed of an alloy consisting essentially of 80–97 w/o W and the balance Ni and Fe in the ratio ranging from 7 Ni:3 Fe to 1 Ni:1 Fe, said plate being formed by the method of claim 17.

32. An alloy plate as recited in claim 31 having a microstructure composed of particles of substantially pure tungsten in an alloy matrix containing tungsten, nickel and iron.

33. An alloy plate as recited in claim 32 wherein the tungsten particles are substantially spheroidized grains having a major diameter of 40–50 micrometers.

34. An alloy plate as recited in claim 33 which is substantially devoid of blisters.

35. An alloy plate formed by the method of claim 20 having a gradient of mechanical properties through its thickness.

36. An alloy plate as recited in claim 35 which has a substantially completely uniform microstructure.

* * * * *

UNITED STATES PATENT AND TRADEMARK OFFICE

CERTIFICATE OF CORRECTION

PATENT NO. : 4,743,512

DATED : May 10, 1988

INVENTOR(S) : DAVID T. MARLOWE, et al.

It is certified that error appears in the above-identified patent and that said Letters Patent is hereby corrected as shown below:

Abstract, line 4, "weiht" should be --weight--;

Column 6, line 3, "1000°F." should be --2000°F.--;

Column 8, line 45, "(0.1 Mpa)" should be --(0.1 MPa)--.

Signed and Sealed this

Sixth Day of June, 1989

*Attest:*

*Attesting Officer*

DONALD J. QUIGG

*Commissioner of Patents and Trademarks*